US005757663A

United States Patent [19]

Lo et al.

[11] Patent Number: 5,757,663

[45] Date of Patent: May 26, 1998

[54] HYDROCARBON RESERVOIR CONNECTIVITY TOOL USING CELLS AND PAY INDICATORS

[75] Inventors: Tak-Sing Lo; Jinchi Chu, both of Plano, Tex.

[73] Assignee: Atlantic Richfield Company, Los Angeles, Calif.

[21] Appl. No.: 533,870

[22] Filed: Sep. 26, 1995

[51] Int. Cl.[6] ..... C10G 5/02

[52] U.S. Cl. ..... 364/509; 364/510; 364/512; 364/578

[58] Field of Search ..... 364/512, 421, 364/422, 556, 506, 509, 510, 578; 395/500, 22; 367/73; 73/152.39, 152.59; 356/445

[56] References Cited

U.S. PATENT DOCUMENTS 5,040,414 8/1991 Graebner ..... 73/152.59
5,144,590 9/1992 Chon .
5,321,612 6/1994 Stewart .
5,475,589 12/1995 Armitage ..... 364/421
5,586,082 12/1996 Anderson et al. ..... 367/73

*Primary Examiner*—Jacques H. Louis-Jacques
*Assistant Examiner*—Dan Fiul
*Attorney, Agent, or Firm*—David L. McCombs

[57] ABSTRACT

A program and method for identifying connectivity of well perforation locations to cells of a reservoir description that meet selected pay criteria. First, a pay indicator is assigned to the cells that satisfy the selected pay criteria. A connectivity indicator is then assigned to the pay indicator-assigned cells that correspond to said well perforation locations. Next, a connectivity indicator is assigned to the pay indicator-assigned cells that are connected, either directly or indirectly through another said pay-indicator-assigned cell, to the well perforation location connectivity indicator-assigned cells. The result is construction of a connectivity index array for the reservoir description that differentiates the connectivity indicator-assigned cells from cells that are not assigned a connectivity indicator. The array may be used to calculate the total volume of the connectivity indicator-assigned cells, thereby estimating the drainage volume, i.e., the total producible volume, of the reservoir description.

28 Claims, 6 Drawing Sheets

TAGGING PAY ZONES AT WELLS

FIRST CAMPAIGN: EAST FROM (4,1)

INVADING NORTH FROM (5,5)

(1,5) CAMPAIGNS COMPLETED

INVADING EAST FROM (5,5)

NEW CAMPAIGN: EAST FROM (9,1)

TAGGING PAY ZONES AT WELLS

SWEEP EAST

CONTINUE

U-TURN

MOP UP

DONE

HYDROCARBON RESERVOIR CONNECTIVITY TOOL USING CELLS AND PAY INDICATORS

TECHNICAL FIELD

The invention relates generally to processing of numerical data which characterize subsurface earth formations. More particularly, the invention relates to a method and a system for estimating the portions of subsurface reservoirs capable of contributing to the production of hydrocarbons. This is done by identifying those regions of the reservoirs where hydrocarbon fluids contained therein can flow to the specified well perforations.

BACKGROUND OF THE INVENTION

In the commercial recovery of hydrocarbons it is desirable to examine the stratigraphy of petroleum producing formations using seismic and other methods for purposes of reservoir definition and evaluation. A common procedure used to calculate recoverable hydrocarbon reserves in the reservoir is simply to multiply the total hydrocarbon in place by a recovery factor, resulting in an estimate of potential reserves that can be inaccurate and overly optimistic. The foregoing procedure fails to recognize, for example, that for low to medium net-to-gross reservoirs consisting of disjointed sand bodies of sizes comparable to, or smaller than, well spacing, some of the hydrocarbon deposits in the sand bodies disconnected from well perforations cannot contribute to production.

An important aspect of reservoir evaluation, therefore, is the determination of possible connectivity of productive formations, such as sand beds or regions of reservoir quality rock, to well perforations, so that the potential production volume can be accurately estimated. Currently, identifying the extent of reservoir connectivity visually is difficult in three dimensions. Further, the alternative method of solving the problem of estimating potential reserves using a fluid flow simulator to generate a model of how hydrocarbons will flow in a porous formation is unduly complicated and time consuming. Moreover, the resulting production volume estimates produced from a fluid flow simulator are susceptible to upscaling artifacts, making them relatively inaccurate.

Consequently, there is a need for an improved tool for identifying and quantifying the connectivity to well perforations of the regions within subsurface reservoir formations meeting selected pay criteria thereby enabling estimate of the connected reservoir volume of hydrocarbons available for commercial recovery.

SUMMARY OF THE INVENTION

The present invention, accordingly, provides a method and a computer software system for identifying and quantifying connectivity of regions within subsurface reservoir formations meeting selected pay criteria to well perforations, thereby enabling estimate of the connected reservoir volume of hydrocarbons available for commercial recovery, that overcome or reduce disadvantages and limitations associated with prior reservoir volume estimation methods and systems.

One aspect of the invention is a method for identifying connectivity of well perforation locations to cells of a reservoir description that meet selected pay criteria. First, a pay indicator is assigned to all the cells that satisfy the selected pay criteria. A connectivity indicator is then assigned to the pay indicator-assigned cells that correspond to said well perforation locations. Next, a connectivity indicator is assigned to the pay indicator-assigned cells that are connected, either directly or indirectly through another said pay-indicator-assigned cell, to the well perforation location connectivity indicator-assigned cells. The result is construction of a connectivity index array for the reservoir description that differentiates the connectivity indicator-assigned cells from cells that are not assigned a connectivity indicator.

In another aspect, the foregoing assignment of connectivity indicators to the cells of a reservoir description enables the construction of a summary of the reservoir description indicating the pay criteria, the number of the pay indicator-assigned cells and the number of the connectivity indicator-assigned cells.

Further, the assignment of connectivity indicators to the cells of a reservoir description also enables calculation of the total volume of the connectivity indicator-assigned cells, thereby estimating the drainage volume, i.e., the total producible volume, of the reservoir description.

In another aspect, two different search algorithms can be used to assign a connectivity indicator to the connected cells of the reservoir description. The first is a direct search method that works very much like the "PACMAN" in the well known video game. Neighboring cells to a well perforation are systematically searched and tagged with a connectivity indicator if the cells are pay cells and are connected to the well perforation cell directly or through another connectivity-assigned cell. From a tagged cell new branches of searches are spawned and the process is repeated for connected paths of pay indicator-assigned cells until a dead end is reached, whereupon the path is retraced until all pay indicator-assigned cells in all connected paths are tagged with a connectivity indicator. The second search algorithm is an iterative method that operates much like a self-propelled sprinkler system watering a field. Starting from one edge of a reservoir description grid (e.g., the western edge), each plane or column (e.g., north-south) of cells parallel to that edge are tested for connectivity to its neighbors (e.g., to the west). This is repeated in a sweep (e.g., eastward) of all planes until the opposite edge is reached. The process is repeated from different edges in different directions. The direct algorithm is faster, but requires more computer memory. For large enough problems, the iterative algorithm is less susceptible to memory limitation.

In a preferred embodiment the invention is implemented as a computer program stored on computer-readable media. The program can run on any UNIX workstation.

A technical advantage achieved with the invention is accuracy in the sense that it only counts the contributing reservoir volumes, based upon selectable pay criteria, in estimating commercially recoverable hydrocarbon volumes. The invention can work on high resolution reservoir descriptions as inputs, and thus is not adversely affected by scale up artifacts.

Another technical advantage achieved is efficiency as compared to reservoir volume estimations utilizing fluid flow simulation tools. Processing performed by the invention, coupled with geostatistical reservoir description techniques, permits more quantitative application of geologic concepts and data in short time constraint projects, such as lease bids, for example.

Another technical advantage achieved is that the invention can be used to screen multiple stochastic reservoir descriptions to minimize the number of cases required to perform later, more detailed, fluid flow simulation studies.

DESCRIPTION OF THE PREFERRED EMBODIMENTS

Figure 1:
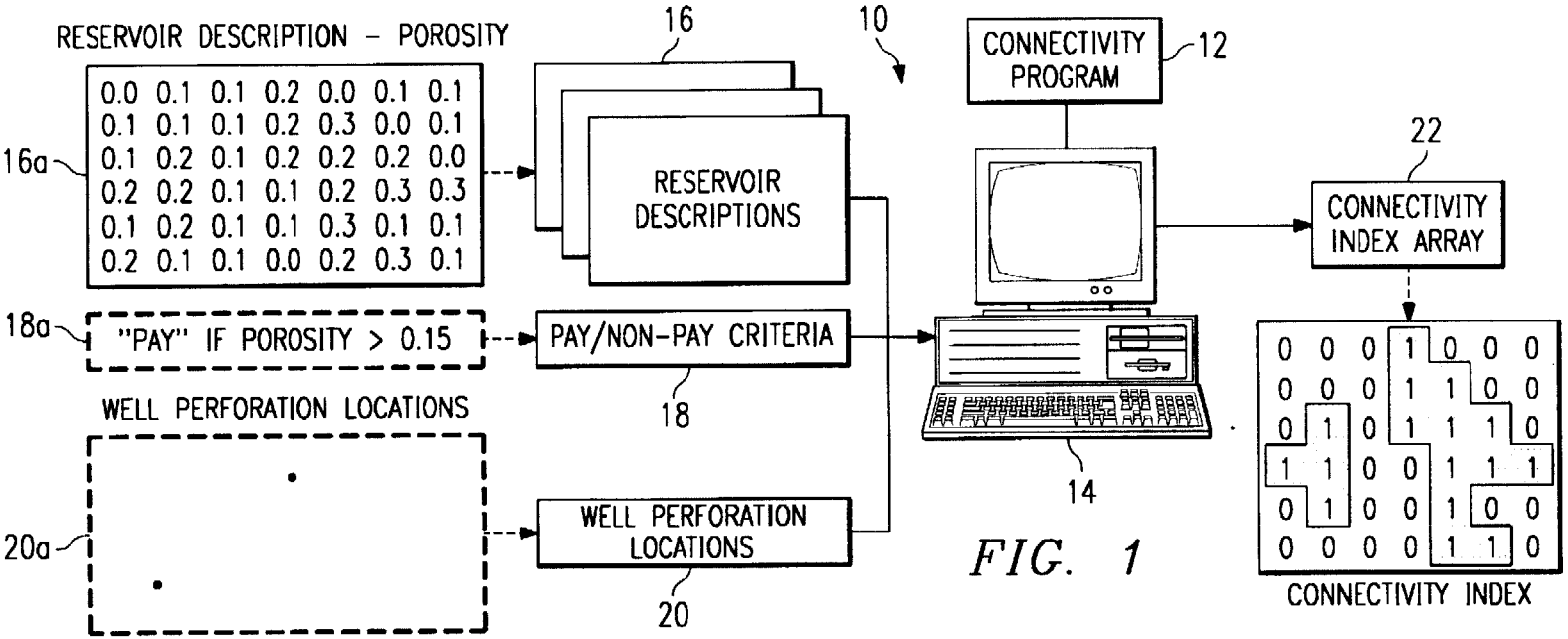
FIG. 1 is a schematic block diagram of a reservoir connectivity analysis system of the present invention.

In FIG. 1, the reference numeral 10 refers to a reservoir connectivity analysis tool, i.e., system, of the present invention. The system 10 includes a connectivity program 12 operatively coupled to a work station 14 for performing functions, described in detail below, relating to identifying connectivity of subsurface reservoir locations (shown schematically in FIG. 2) that meet selected "pay," i.e., profitable recovery, criteria, to well perforations. The work station 14 is any UNIX workstation.

Input files of the system 10 include at least one reservoir description file 16, a pay parameter file 18 and a well completion file 20, explained subsequently in detail. Output of the system 10 is a connectivity index array 22. The array 22 comprises "0's" and "1's" in which the 1's represent cells of a reservoir that, according to a reservoir description in the file 16, satisfy pay parameters of the file 18 and are connected to well completion locations of the file 20 either directly, or indirectly through one or more other cells that satisfy the pay parameters. Files **16*a*, 18*a*, 20*a*, and 22*a* are illustrative examples of the respective files 16, 18, 20, and 22**, and are described further below.

Figure 2:
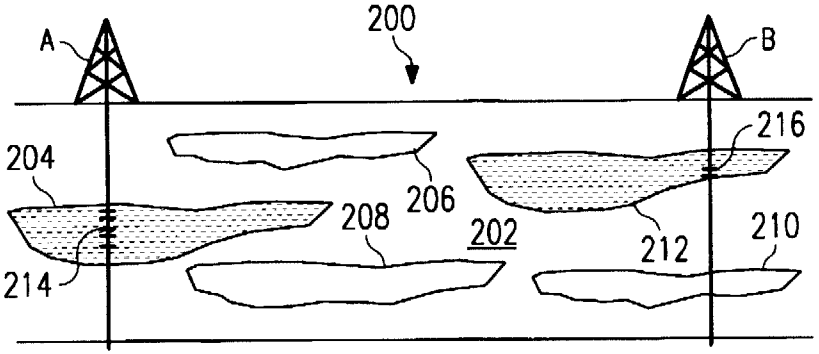
FIG. 2 is a schematic diagram of the environment from which reservoir descriptions are obtained for input to the system of FIG. 1.

FIG. 2 illustrates an environment 200 upon which the system 10 operates. A subsurface reservoir 202 defines several disjointed sand bodies 204, 206, 208, 210, and 212 each of which contains hydrocarbon deposits (not shown). While not shown, it is understood that each of the sand bodies 204–212 can be divided, for analysis purposes, into multiple three-dimensional cells and that each cell represents a particular volume location within reservoir 202. Production wells A and B extend into the reservoir 20 202. Perforations 214 and 216 indicate subsurface locations at which the respective wells A and B are completed, i.e., locations at which the wells are capable of recovering hydrocarbons. The sand bodies 204 and 212 are shaded to indicate "connectivity" of cells therein (not shown) to the well completion locations defined by the respective perforations 214, 216.

A cell of the sand bodies 204, 212, is said to be "connected" for purposes of the present invention if it satisfies two conditions. First, the cell must satisfy some user specified pay/non-pay criteria, e.g., porosity, permeability threshold, or particular rock type. Second, a fluid in the volume defined by the cell must be able to flow to some part of the well completions along a fluid path uninterrupted by flow barriers such as shales or sealing faults. For example, if a cell does not meet a specified pay criteria, hydrocarbon recovery from that cell is not commercially desirable.

Referring to both FIGS. 1 and 2, the system 10 determines connectivity of reservoir cells in the environment 200 by outputting an array 22 of "1" and "0" connectivity indices, wherein the 1's represent cells connected by an uninterrupted fluid flow path to the well perforations, i.e., completions, as defined in the well perforation location file 20 and likewise satisfy the pay criteria specified in the parameter file 18, associated with given reservoir descriptions in the description file 16. As an example, FIG. 1 illustrates output of the array **22*a*, which for simplicity of illustration, is a two-dimensional array. Inputs used to generate the array 22*a* are the reservoir description file 16*a*, the pay parameter file 18*a*, and the well perforation location file 20*a*. The reservoir description file 16*a* defines, in a two-dimensional grid of cells, a reservoir property of porosity, whose connectivity is to be estimated. Thus a single pay parameter, porosity, is expressed in the parameter file 18*a* wherein a cell is designated as "pay," i.e., hydrocarbons can be profitably recovered from it, if the porosity is greater than 0.15 porosity units. Other criteria can be substituted for a porosity cutoff, e.g., permeability, etc. The well perforation file 20*a*** indicates two well completion locations from which connectivity is to be determined.

Although the foregoing example files **16*a*, 18*a*, 20*a* and 22*a* are simplified for purposes of illustration, it is understood that in application of the system 10, complex inputs and outputs are contemplated that reflect very accurate estimates of reservoir conditions. The description file 16 may describe multiple properties in three dimensions. Likewise, the parameter file 18 may define more complex pay criteria involving porosity, permeability, depth, cell thickness, or other reservoir properties whose connectivity is to be estimated. The well perforation location file 20 may describe any number of well completions in three dimensions. The output of array 22** is typically a three dimensional array and, as explained further below, may be used to compute the volume of recoverable hydrocarbons.

Figure 3:
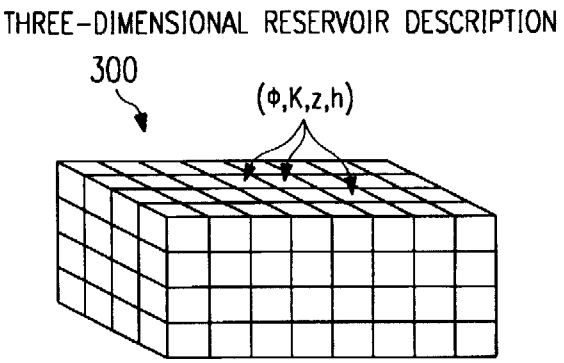
FIG. 3 is schematic diagram of an example three-dimensional reservoir description for input to the system of FIG. 1.

FIG. 3 graphically illustrates a three-dimensional reservoir description 300. In the preferred embodiment the one or more reservoir description files 16 are three dimensional, deterministic or stochastic, descriptions of the reservoir 202 provided in a regularly-gridded data format. For reservoirs whose description is not known exactly, multiple, equally probable, stochastic descriptions may be used, in which case the uncertainty of the connectivity can be evaluated also by the system 10. Values of the pay criteria (defined in the pay parameter file 18), such as facies, porosity, permeability, depth, cell thickness, or any other reservoir property whose connectivity is to be estimated, are likewise expressed in a three dimensional grid. In the grid 300, for example, the properties of interest are porosity ($\Phi$), permeability (K), depth (z), and cell thickness (h).

Referring again to FIG. 1, the reservoir description files 16 are in a multi-column GSLIB data format wherein the header lines define the number of data columns are what type of data each column contains. Table I below illustrates an example of a GSLIB datafile representative of the reservoir description file 16.

TABLE I

| Reservoir Description File | |
|---|---|
| Conquest.dat | \title |
| 2 | \number of variables/columns in file |
| Permeability | \variable name, one line for each variable |
| Porosity | \variable name, one line for each variable |
| 0.20 0.0424 | \permeability and porosity for first cell |
| 1.30 0.1145 | \permeability and porosity for second cell |
| . | . |
| . | . |
| 7.10 0.2140 | \permeability and porosity for nth cell |

In Table I the reservoir description file includes reference to properties of permeability and porosity, for a three dimensional grid of n cells. Typically, the cells listed sequentially in the file define a three dimensional grid that starts from one corner and cycles first in the x-direction and then in the y-direction, and then in an increasing z-direction.

Table II below is an example of the pay parameter file 18, expressed in a GSLIB format used to run the system 10.

TABLE II

| Parameter File | |
|---|---|
| START of Parameters | |
| conquest.dat | \reservoir description file, required |
| 2 | \column of variable in file |
| 1 1 | \description start, end |
| 120 0.0 1.0 | \grid nx, xmin, xinc |
| 80 0.0 1.0 | \grid ny, ymin, yinc |
| 1 0.0 1.0 | \grid nz, zmin, zinc |
| depth.dat | \cell depth file, optional |
| no-erosion | \erosion depth file, optional |
| 1E20 | \oil/gas water contact |
| 0.20 | \pay/non-pay cutoff |
| conquest.prf | \well perforation file, required |
| 0 | \1 = allow diagonal connection |
| 0 | \algorithm: 0 = DIRECT, 1 = INTERACTIVE |
| 3 | \debugging level |
| conquest.dbg | \debugging file |
| conquest.out | \output connectivity index file |
| conquest.sum | \summary file |

In Table II, the parameter file first references the input file name (the UNIX path name) containing the reservoir description (in this instance, "Conquest.dat," from Table I). If multiple descriptions are processed, they are given sequential root names. The "column of variable in file" line of Table II specifies the column identification corresponding to the variable which is to be used as a pay or non-pay indicator. For example, in the above description file if a threshold porosity is to be used as the pay criteria, then the "column in file" is 2. The grid specification (number of cells, location of origin and size of each cell) in each direction is indicated by nx, xmin, xinc; ny, ymin, yinc; and nz, zmin, zinc. The pay/non-pay cutoff is a threshold used to determine if a cell is pay or non-pay, whereby a cell is only tagged as pay if it meets the criteria specified. "Allow diagonal connection" is used to enable or disable connectivity in a diagonal direction of the cells. If set to 1, connectivity between diagonal cells is permitted which will usually give a larger connected drainage volume. However, if the grid resolution is not fine enough, there is a risk of introducing artificial linkages between close-by but disjointed sand bodies or oil lenses.

The parameter file of Table II offers a choice of algorithms for determining connectivity. They are a direct algorithm ("0") and an interative algorithm ("1"). The programs are discussed subsequently in detail with reference to FIGS. 4–8.

In Table II the "output connectivity index file" line specifies the root name of the GSLIB format output files containing the connectivity index array(s) 22 (FIG. 1). For multiple reservoir description files 16 as the input, the outputs will be arrays in separate files. Each file will contain an array 22 of 0's and 1's stored in the same order as the pay/non-pay indicator variable appears in the reservoir description file 16. The "summary file" line specifies the root name of the GSLIB format output file containing summary information on the connected drainage volume, one line for each reservoir description. Table III below is an example of a summary file.

TABLE III

| Summary File |
|---|
| Connectivity Analysis: file = Conquest.dat |
| 2 variables |
| Description ID |
| Total Pay (out of 9600) |
| Total Connected: cutoff = 0.15 |
| 1 4885 3852 |
| 2 4893 3864 |

In Table III note that "Total Pay" and "Total connected" are expressed in terms of the number of cells, not in physical volume.

Table IV below is an example of the well completion file 20 containing the well completion, i.e., perforation, information. The file 20 is expressed in GSLIB data format.

TABLE IV

| Well Completion File | | | | |
|---|---|---|---|---|
| Well Perforation Data For Conquest.dat | | | | |
| 11 columns | | | | |
| Column 01: Well Name | | | | |
| Column 02: X location of one end of perforated segment | | | | |
| Column 03: Y location of one end of perforated segment | | | | |
| Column 04: Z location of one end of perforated segment | | | | |
| Column 05: X location of other end of perforated segment | | | | |
| Column 06: Y location of other end of perforated segment | | | | |
| Column 07: Z location of other end of perforated segment | | | | |
| Column 08: Drainage Radius in X (0 = do not use) | | | | |
| Column 09: Drainage Radius in Y (0 = do not use) | | | | |
| Column 10: Drainage Radius in Z (0 = do not use) | | | | |
| Column 11: Option (0 = shut in; 1 = in service) | | | | |
| DS3-1 | 20 35 0 | 20 35 1.0 | 0 0 0 | 1 |
| DS3-2 | 90 10 0 | 90 10 1.0 | 0 0 0 | 0 |
| DS3-4 | 45 15 0 | 45 15 0.5 | 0 0 0 | 1 |

In Table IV, each line specifies one perforation segment, indicated by the start and end locations in field or nominal coordinates (consistent with the grid specification).

Figure 4:
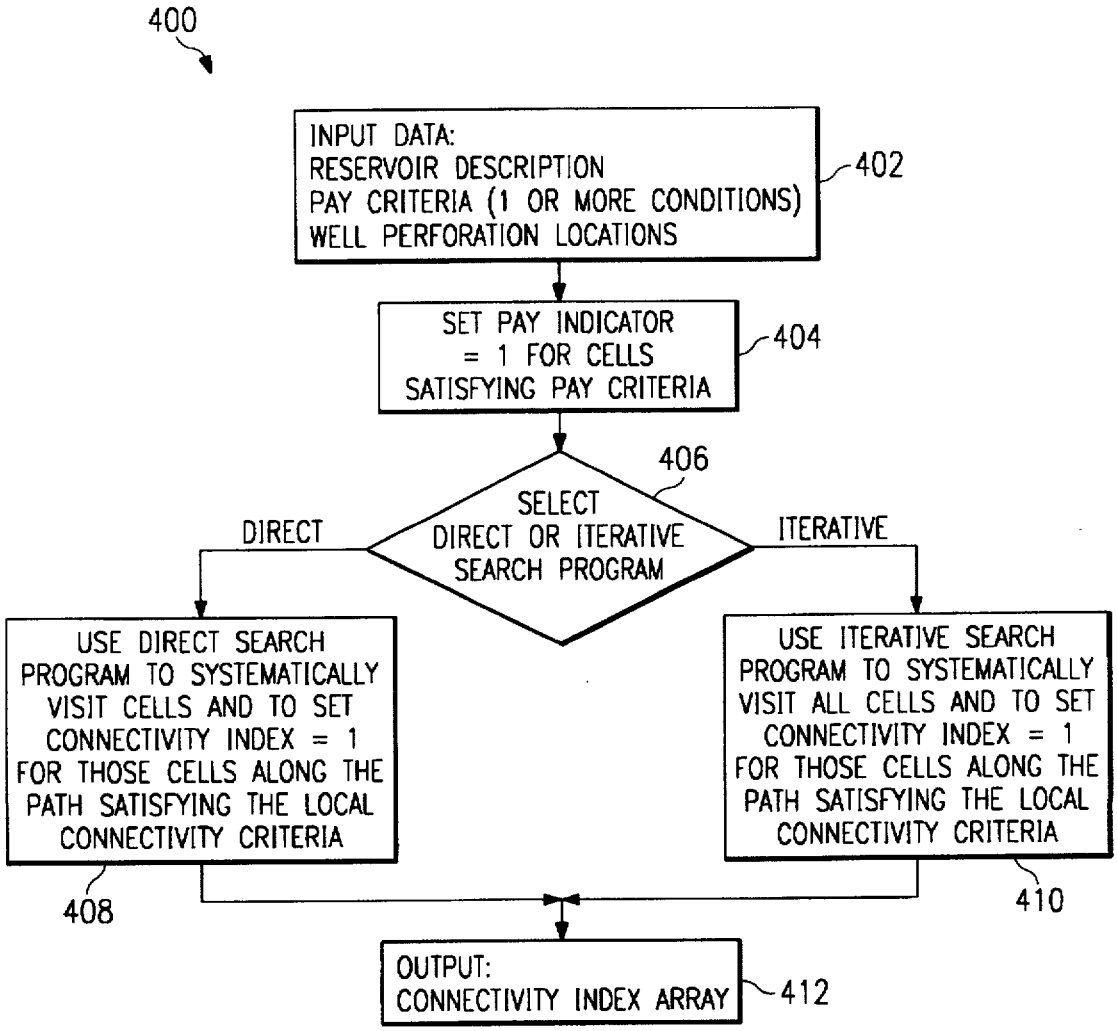
FIG. 4 is a process control flow diagram of the reservoir connectivity analysis system of FIG. 1.
Figure 5:
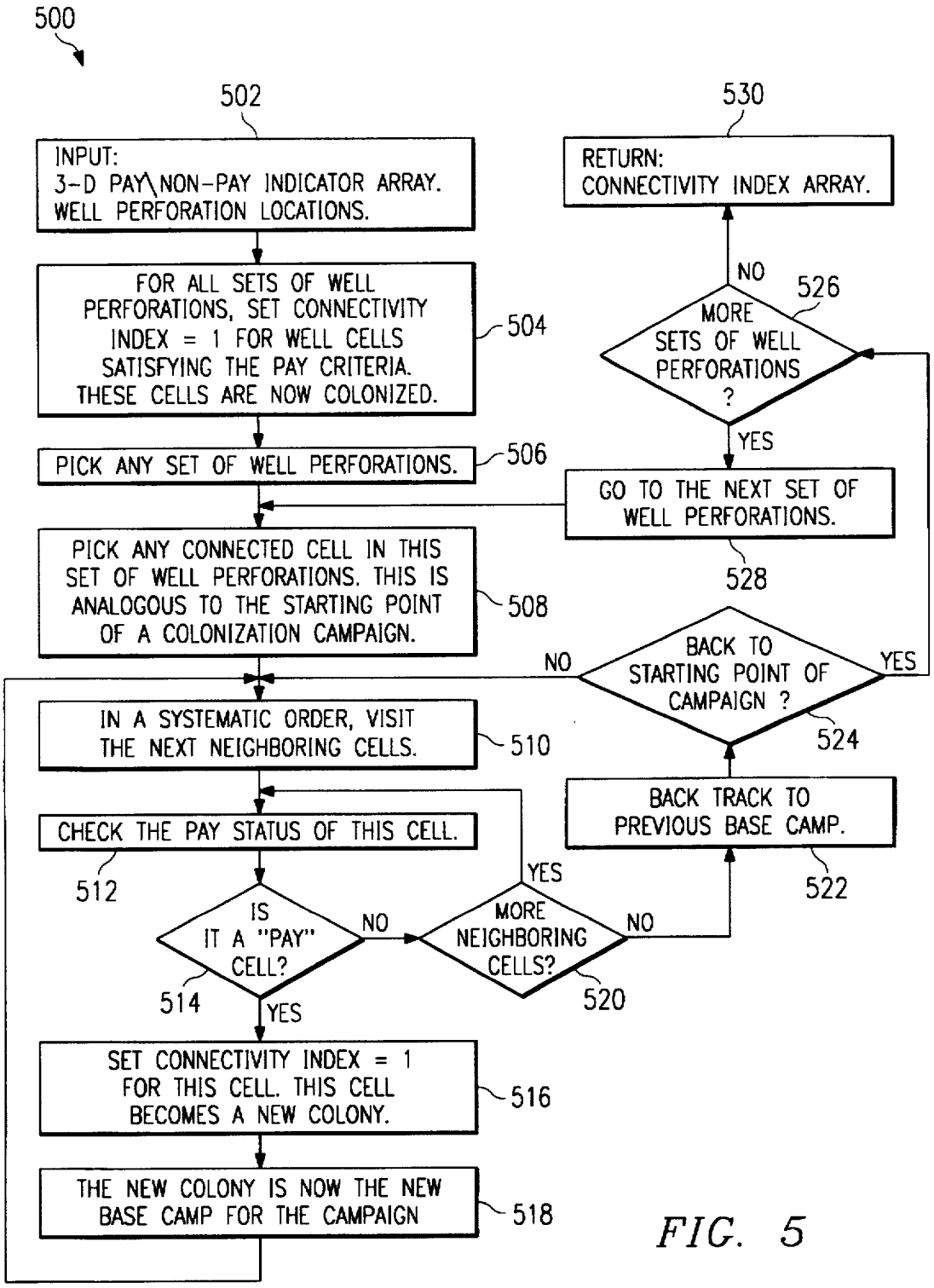
FIG. 5 is a detailed process control flow diagram of a direct search process for setting cell connectivity indices, referred to generally in step 408 of FIG. 4.

FIG. 4 is a process control flow diagram 400 illustrating operation of the system 10. In step 402 the work station 14 (FIG. 1) receives as data input one or more reservoir description files 16, the parameter file 18 and the well perforation locations file 20. In step 404 a flag, i.e., pay indicator (see Table II), is set to 1 for each cell of the reservoir description in the file 16 satisfying the pay criteria defined in the file 18. In step 406 a selection is made of either a direct search algorithm (step 408) or an iterative search algorithm (step 410) for performing the connectivity testing of the cells of the reservoir description. In step 408 the direct search algorithm, described in detail below with reference to FIGS. 5 and 6, is utilized to perform connectivity testing of the cells. In step 410 the iterative search algorithm, described in detail below with reference to FIGS. 7 and 8, is utilized to perform connectivity testing of the cells. As explained below, the search algorithm of steps 408 or 410 operate to set a connectivity index for each cell to either 0 or 1, where 1 represents cells of a reservoir that satisfy the pay criteria and are also connected to well perforation locations either directly, or indirectly through one or more other cells that also satisfy the pay criteria. In step 412 the connectivity index array 22 is output from the work station 14. While not shown in FIG. 1, it is understood that the work station 14 also is able to produce summary files (Table III) as an output. In addition, further processing can be performed to generate connected drainage volume from the reservoir or other useful reservoir quantity information.

FIG. 5 is a process flow diagram illustrating operation of the direct search program, referred to in step 408 in FIG. 4, used to generate the connectivity index array 22.

FIGS. 6A–6F schematically illustrate the operations explained in FIG. 5 using for simplicity a two-dimensional cell array 600, it being understood that the operations are performed in the same manner for a three dimensional array. FIG. 6G is a legend explaining the symbols used in the grid 600 of FIGS. 6A–6F.

Figure 6A:
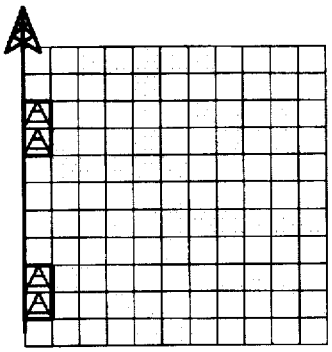
FIGS. 6A–6F are graphical representations of the direct search process for setting cell connectivity indices as performed by the process flow of FIG. 5.
Figure 6B:
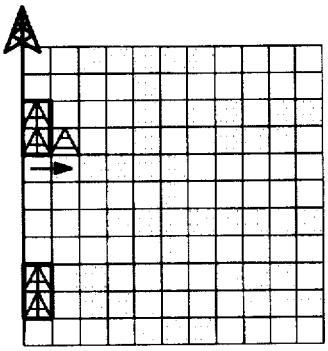
Figure 6C:
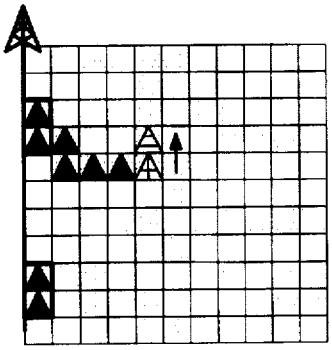
Figure 6D:
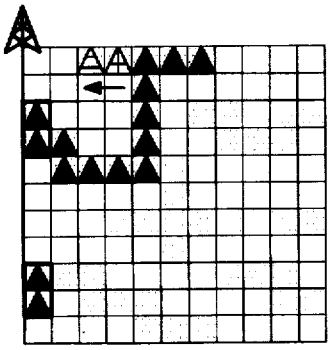
Figure 6E:
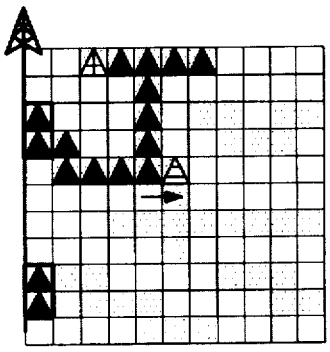
Figure 6F:
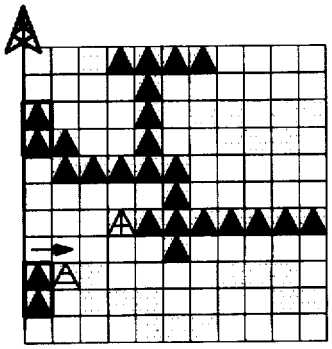
Figure 6G:
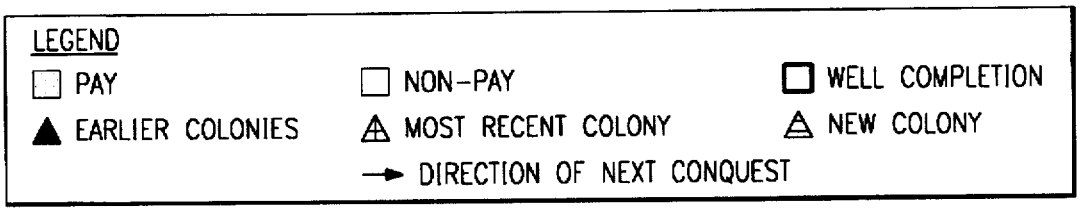
FIG. 6G is a legend of the symbols used in FIGS. 6A–6F.
Figure 7:
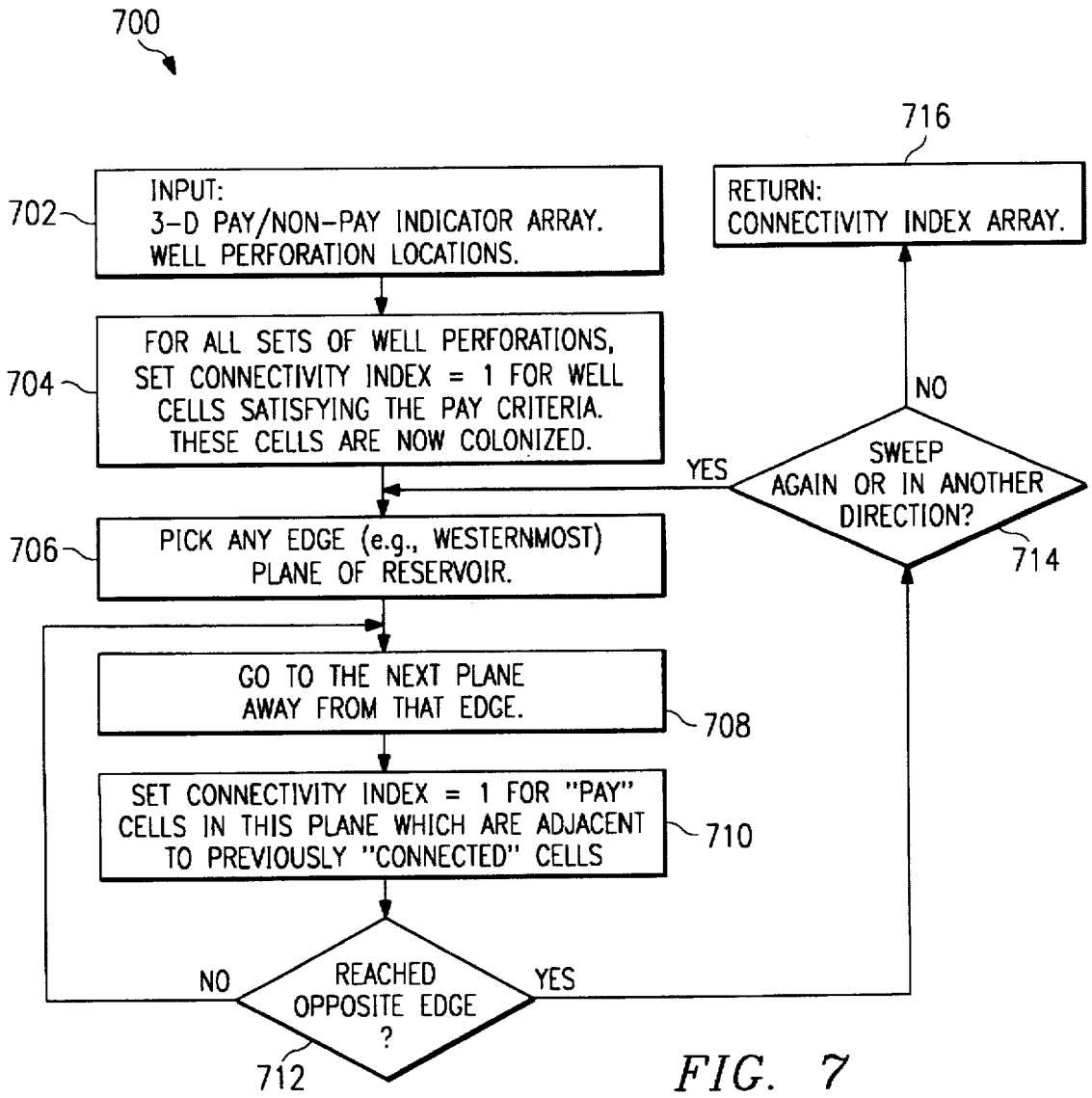
FIG. 7 is a detailed process control flow diagram of an iterative search process for setting cell connectivity indices, referred to generally in step 410 of FIG. 4.

Referring to FIGS. 5 and 6A–6G, operation of the direct search program of step 408 is herein described. The direct search program is informally referred to as the "PACMAN" search program because it works very much the "PACMAN" in the well known video game. In step 502 the input to the program is a three dimensional array with a pay indicator assigned to all cells which satisfy the pay criteria. In step 504 a connectivity index of 1 is assigned to all cells satisfying the pay criteria that also coincide with a well perforation location. As shown in FIG. 6A, these cells are identified as newly colonized cells, i.e., tagged pay zones at wells.

In step 506, an arbitrary set of newly colonized cells ("pay" cells coinciding with well perforations) is picked. In step 508, from the set, any one of the colonized cells is picked as a starting point of a colonizing campaign. In step 510, starting from the picked cell (4, 1), the neighboring cells are visited systematically and in steps 512 and 514 the cells are tested for whether they have a pay indicator assigned thereto or not. If any one of the tested cells has a pay indicator assigned to it, i.e., it is a "connected" cell, and therefore it is tagged as connected by, in step 516, assigning it a connectivity index of 1. Each tagged cell, as set forth in step 518, is now a "base camp" for a new colony and spawns a new branch of search of its own neighboring cells (FIG. 6C, from (5, 5)), by return of execution to step 510. Specifically, if in step 514 a determination is made that a neighboring cell is not a pay cell, i.e., it does not have a pay indicator assigned to it, a determination is made in step 520 whether there are more neighboring cells. If there are more neighboring cells execution returns to step 512 and their status is checked. If in step 520 there are no more neighboring cells to check, i.e., a "dead end" is reached (FIG. 6D, campaigns (1, 5) completed), execution proceeds to step 522.

In step 522, after reaching a dead end in a campaign, where no new branches are spawned or cells are tagged, the path is retraced by back-tracking to the previous branching point, i.e., base camp (FIG. 6E, (5, 5), and another branch is pursued by return of execution to step 510. In step 524 a determination is made if the retracing has resulted in return all the way to the original starting point of the campaign (FIG. 6A, (4, 1)). If not, the retracing, with occasional branching, (FIG. 6E, invading east from (5, 5)), is repeated by return of execution to step 510 until all pay cells connected to the original starting cell of the campaign are tagged with a connectivity index of 1. In step 524 if retracing is accomplished back to the original cell of the campaign, in step 526 a determination is made if there are more sets of well perforation locations, i.e., new colonies to explore. If so, in step 528 execution returns to step 508 and the next new campaign is started (FIG. 6F, east from (9, 1)). If there are no more sets of new colonies to explore in step 526, execution proceeds to step 530 wherein the connectivity array 22 is completed and returned as a separate file.

FIG. 7 is a process flow diagram illustrating operation of the iterative search program, referred to in step 410 in FIG. 4, that is used to generate the connectivity index array 22.

Figure 8A:
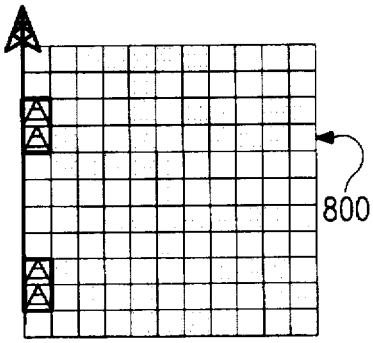
FIGS. 8A–8F are graphical representations of the iterative search process for setting cell connectivity indices as performed by the process flow of FIG. 7.
Figure 8B:
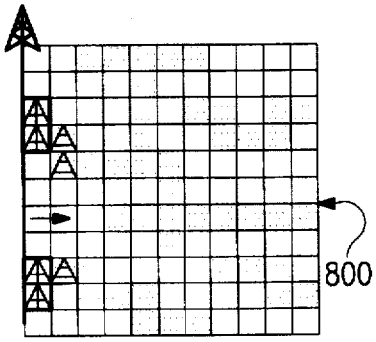
Figure 8C:
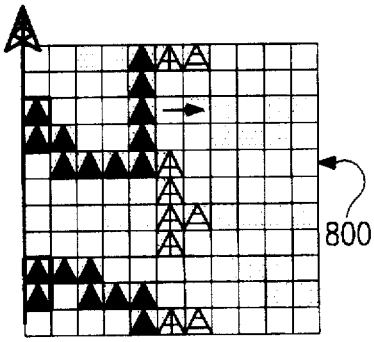
Figure 8D:
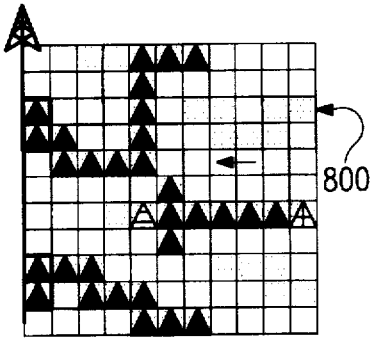
Figure 8E:
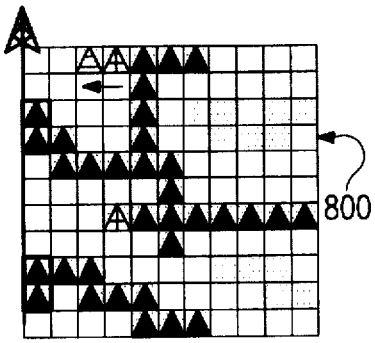
Figure 8F:
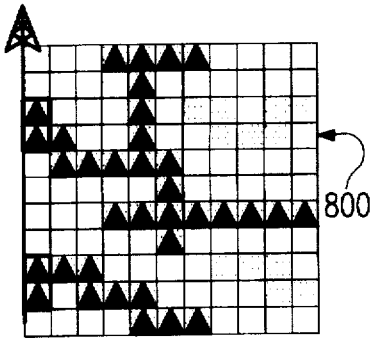
Figure 8G:
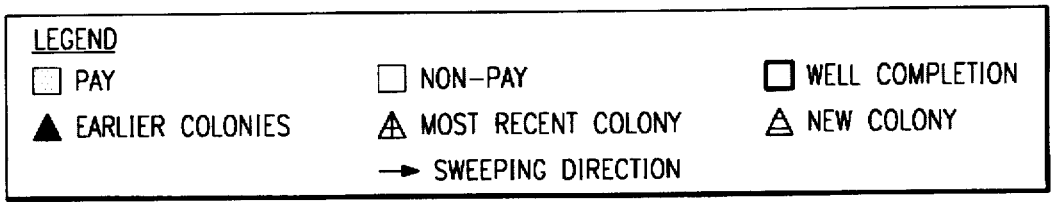
FIG. 8G is a legend of the symbols used in FIGS. 8A–8F.

FIGS. 8A–8F schematically illustrate the operations explained in FIG. 7 using for simplicity a two-dimensional cell array 800, it being understood that the operations are performed in the same manner for a three dimensional array. FIG. 8G is a legend explaining the symbols used in the grid 800 of FIGS. 8A–8F.

Referring to FIGS. 7 and 8A–8G, operation of the direct search program of step 410 is herein described. The direct search program is informally referred to as the "SPSS" search program because it works very much like a self-propelled sprinkler system watering a field. Generally, as shown in FIGS. 8A–8F, starting from the western edge (using a standard north-south, east-west convention), of the grid 800, each north-south column (for a 2-dimension grid) or plane (for a 3-dimension grid) of cells parallel to that side is tested for connectivity to its neighbor cells in the column or plane to the west. This is then repeated on the next neighboring column or plane to the east until the eastern edge of the reservoir is reached. This process is repeated for a western sweep, starting from the eastern edge, if necessary. This process may have to be repeated several times in different directions until all connected cells are tagged.

In step 702 the input to the program is a three dimensional array with a pay indicator assigned to all cells which satisfy the pay criteria. In step 704 a connectivity index of 1 is assigned to all cells satisfying the pay criteria that also coincide with a well perforation location. As shown in FIG. 8A, these cells are identified, i.e., "tagged," as newly colonized.

In step 706, an arbitrary, e.g., westernmost edge column or plane of the grid 800 is selected for testing and for sweep across the grid to the other edge. In the first column or plane on the westernmost edge, connectivity index of 1 is assigned to all pay cells in the well perforations within this column or plane (FIG. 8A). In step 708, the next column or plane is tested and pay cells adjacent the "connected" cells (i.e., those assigned a connectivity index of 1) are also assigned a connectivity index of 1 (FIGS. 8B, 8C). In step 712 a determination is made if the sweep has reached the opposite edge. If not, execution returns to step 708 and if so, a determination is made whether to sweep again or in another direction, such as east-west or north-south, south-north. The process may need to be repeated several times in different directions to catch all of the connected cells.

Several advantages result from the use of the system 10 to generate a connectivity index array. One advantage is accuracy in the sense that the system 10 only counts the contributing reservoir volumes, based upon selectable pay criteria, in estimating commercially recoverable hydrocarbon volumes. The system 10 also can work on high resolution reservoir descriptions as inputs, and thus is not adversely affected by scale up artifacts often associated with the low resolution fluid flow simulation grids.

Processing performed by the system 10, coupled with geostatistical reservoir description techniques, permits more quantitative application of geologic concepts and data in short time constraint projects, such as lease bids. Another technical advantage achieved is that the system 10 can be used to screen multiple stochastic reservoir descriptions to minimize the number of cases required to perform later, more detailed, fluid flow simulation studies.

Both the direct search program and the iterative search program of the system 10 are much faster than flow simulations because they only involve simple logical testing and assignments of a connectivity index at each cell location, instead of solving a set of differential equations describing fluid flow processes. The direct ("PACMAN") search program is extremely fast but takes up more memory while the iterative (SPSS) search program is slower but is more memory efficient. Further, the directional nature of the iterative search program has the advantage of facilitating the calculation of reservoir volume contributing to fluid displacement processes such as water or gas floods. Both the direct and iterative search programs can process million-cell reservoir descriptions in less than one minute on an IBM RS/6000-580 version of the work station 14.

It is understood that the present invention can take many forms and embodiments. The embodiments shown herein are intended to illustrate rather than to limit the invention, it being appreciated that variations may be made without departing from the spirit of the scope of the invention. For example, any number of different pay criteria may be analyzed. Different reservoir descriptions are contemplated. The search algorithm or other process functions performed by the system may be organized into any number of different modules or computer programs for operation on one or more processors or work stations. The computer of the system 10 may not be required if the same functions are implemented on a processor of a fluid flow simulator tool. The programs may be used to create connectivity indices for other parameters than those mentioned in the preferred embodiment. The techniques of the present invention may also apply to analyses other than those of the preferred embodiment. The invention can also be used to determine the probability of sand or shale connectivity between completions in an offset well. The programs may be implemented in any appropriate programming language and run in cooperation with any computer system or tool.

Although illustrative embodiments of the invention have been shown and described, a wide range of modification, change and substitution is intended in the foregoing disclosure and in some instances some features of the present invention may be employed without a corresponding use of the other features. Accordingly, it is appropriate that the appended claims be construed broadly and in a manner consistent with the scope of the invention.

What is claimed is:

1. A computer program for identifying and quantifying connectivity of well perforation locations to cells of a gridded reservoir description that meet selected pay criteria, the program stored on a computer-readable media, comprising:

instructions for assigning a pay indicator to said cells that satisfy said selected pay criteria;

instructions for assigning a connectivity indicator to said pay indicator-assigned cells that correspond to said well perforation locations; and instructions for assigning a connectivity indicator to said pay indicator-assigned cells that are connected, either directly or indirectly through another said pay-indicator-assigned cell, to said well perforation location connectivity indicator-assigned cells, including searching immediately connected cells for pay-indicator-assigned cells and assigning a connectivity indicator to said immediately connected pay indicator-assigned cells.

2. The program of claim 1 further comprising instructions for constructing an array of said reservoir description differentiating said connectivity indicator-assigned cells from cells that are not assigned a connectivity indicator.

3. The program of claim 1 further comprising instructions for constructing a summary of said reservoir description indicating said pay criteria, the number of said pay indicator-assigned cells and the number of said connectivity indicator-assigned cells.

4. The program of claim 1 further comprising instructions for calculating the total volume of said connectivity indicator assigned cells thereby indicating the effective drainage volume of said reservoir description.

5. The program of claim 1 further comprising instructions for selecting between first and second definitions of connectivity for purposes of determining whether two cells are connected for purposes of assigning a connectivity indicator thereto, such that according to said first definition two cells are considered connected if they are adjacent at any face, and such that according to said second definition two cells are considered connected if they are adjacent at any face or if they are adjacent diagonally.

6. The program of claim 1 wherein said selected pay criteria comprises one or more pay parameters.

7. The program of claim 1 wherein said one or more pay parameters include porosity.

8. The program of claim 1 wherein said one or more pay parameters include permeability.

9. The program of claim 1 wherein said one or more pay parameters include facies type.

10. The program of claim 1 wherein said cells of said reservoir description define either a 2-dimensional or a 3-dimensional grid.

11. A computer program for identifying and quantifying connectivity of well perforation locations to cells of a gridded reservoir description that meet selected pay criteria, the program stored on a computer-readable media, comprising:

instructions for assigning a pay indicator to said cells that satisfy said selected pay criteria:

instructions for assigning a connectivity indicator to said pay indicator-assigned cells that correspond to said well perforation locations; and instructions for assigning a connectivity indicator to said pay indicator-assigned cells that are connected, either directly or indirectly through another said pay-indicator-assigned cell, to said well perforation location connectivity indicator-assigned cells, wherein said instructions for assigning a connectivity indicator to said connected cells comprise the steps of:

(a) from a said well perforation location connectivity-assigned cell, searching immediately connected cells for pay-indicator-assigned cells;

(b) assigning a connectivity indicator to said immediately connected pay indicator-assigned cells;

(c) continuing said searching and said connectivity indicator assigning of immediately connected cells along a connected path of said pay indicator-assigned cells until a dead end or a branching junction of pay indicator-assigned cells is reached;

(d) from a said branching junction, continuing said searching and said connectivity indicator assigning of immediately connected cells along any connected path branch of said pay indicator-assigned cells until a dead end is reached;

(e) upon reaching a dead end, back tracking to each said branching junction and continuing, along another unsearched connected path branch, said searching and said connectivity indicator assigning of immediately connected cells;

(f) repeating steps (c) through (e) until all connected path branches of all branching junctions are searched and connectivity indicator-assigned; and (g) repeating steps (a) through (f) for each said well perforation location connectivity-assigned cell until finished.

12. A computer program for identifying and auantifying connectivity of well perforation locations to cells of a gridded reservoir description that meet selected pay criteria, the program stored on a computer-readable media, comprising:

instructions for assigning a pay indicator to said cells that satisfy said selected pay criteria;

instructions for assigning a connectivity indicator to said pay indicator-assigned cells that correspond to said well perforation locations; and instructions for assigning a connectivity indicator to said pay indicator-assigned cells that are connected, either directly or indirectly through another said pay-indicator-assigned cell, to said well perforation location connectivity indicator-assigned cells, wherein said instructions for assigning a connectivity indicator to said connected cells comprise the steps of:

(a) from any first edge plane of said cells of said reservoir description, searching said plane of said cells for pay-indicator-assigned cells that correspond to said well perforation locations;

(b) assigning a connectivity indicator to said well perforation location pay-indicator-assigned cells; and (c) sweeping sequentially from one plane of cells to the next toward the opposing edge from said first edge plane until said opposite edge is reached, assigning a connectivity indicator to said pay indicator-assigned cells that are immediately connected to said connectivity indicator assigned cells in the preceding plane of cells, and to well perforation location pay indicator-assigned cells.

13. The program of claim 12 further comprising the step of:

repeating steps (a) through (c) from said opposite edge plane of cells to said first edge plane.

14. The program of claim 12 further comprising the step of repeating steps (a) through (c) for other edge planes of said reservoir description.

15. A method for identifying connectivity of well perforation locations to cells of a reservoir description that meet selected pay criteria, the method comprising the steps of:

assigning a pay indicator to said cells that satisfy said selected pay criteria;

assigning a connectivity indicator to said pay indicator-assigned cells that correspond to said well perforation locations; and assigning a connectivity indicator to said pay indicator-assigned cells that are connected, either directly or indirectly through another said pay-indicator-assigned cell, to said well perforation location connectivity indicator-assigned cells, including searching immediately connected cells for pay-indicator-assigned cells and assigning a connectivity indicator to said immediately connected pay indicator-assigned cells.

16. The method of claim 15 further comprising the step of constructing an array of said reservoir description differentiating said connectivity indicator-assigned cells from cells that are not assigned a connectivity indicator.

17. The method of claim 15 further comprising the step of constructing a summary of said reservoir description indicating said pay criteria, the number of said pay indicator-assigned cells and the number of said connectivity indicator-assigned cells.

18. The method of claim 15 further comprising the step of calculating the total volume of said connectivity indicator assigned cells thereby indicating the drainage volume of said reservoir description.

19. The method of claim 15 further comprising the step of selecting between first and second definitions of connectivity for purposes of determining whether two cells are connected for purposes of assigning a connectivity indicator thereto, such that according to said first definition two cells are considered connected if they are adjacent at any face, and such that according to said second definition two cells are considered connected if they are adjacent at any face or if they are adjacent diagonally.

20. The method of claim 15 wherein said selected pay criteria comprises one or more pay parameters.

21. The method of claim 15 wherein said one or more pay parameters include porosity.

22. The method of claim 15 wherein said one or more pay parameters include permeability.

23. The method of claim 15 wherein said one or more pay parameters include facies.

24. The method of claim 15 wherein said cells of said reservoir description define either a 2-dimensional or a 3-dimensional grid.

25. A method for identifying connectivity of well perforation locations to cells of a reservoir description that meet selected pay criteria, the method comprising the steps of:

assigning a pay indicator to said cells that satisfy said selected pay criteria;

assigning a connectivity indicator to said pay indicator-assigned cells that correspond to said well perforation locations; and assigning a connectivity indicator to said pay indicator-assigned cells that are connected, either directly or indirectly through another said pay-indicator-assigned cell, to said well perforation location connectivity indicator-assigned cells, wherein said step of assigning a connectivity indicator to said connected cells comprises the steps of:

(a) from a said well perforation location connectivity-assigned cell, searching immediately connected cells for pay-indicator-assigned cells;

(b) assigning a connectivity indicator to said immediately connected pay indicator-assigned cells;

(c) continuing said searching and said connectivity indicator assigning of immediately connected cells along a connected path of said pay indicator-assigned cells until a dead end or a branching junction of pay indicator-assigned cells is reached;

(d) from a said branching junction, continuing said searching and said connectivity indicator assigning of immediately connected cells along any connected path branch of said pay indicator-assigned cells until a dead end is reached;

(e) upon reaching a dead end, back tracking to each said branching junction and continuing, along another unsearched connected path branch, said searching and said connectivity indicator assigning of immediately connected cells;

(f) repeating steps (c) through (e) until all connected path branches of all branching junctions are searched and connectivity indicator-assigned; and (g) repeating steps (a) through (f) for each said well perforation location connectivity-assigned cell until finished.

26. A method for identifying connectivity of well perforation locations to cells of a reservoir description that meet selected pay criteria the method comprising the steps of:

assigning a pay indicator to said cells that satisfy said selected pay criteria:

assigning a connectivity indicator to said pay indicator-assigned cells that correspond to said well perforation locations; and assigning a connectivity indicator to said pay indicator-assigned cells that are connected, either directly or indirectly through another said pay-indicator-assigned cell, to said well perforation location connectivity indicator-assigned cells, wherein said step of assigning a connectivity indicator to said connected cells comprises the steps of:

(a) from any first edge plane of said cells of said reservoir description, searching said plane of said cells for pay-indicator-assigned cells that correspond to said well perforation locations;

(b) assigning a connectivity indicator to said well perforation location pay-indicator-assigned cells; and (c) sweeping sequentially from one plane of cells to the next toward the opposing edge from said first edge plane until said opposite edge is reached, assigning a connectivity indicator to said pay indicator-assigned cells that are immediately connected to said connectivity indicator assigned cells in the preceding plane of cells, and to well perforation location pay indicator-assigned cells.

27. The method of claim 26 further comprising:

repeating steps (a) through (c) from said opposite edge plane of cells to said first edge plane.

28. The method of claim 26 further comprising repeating steps (a) through (c) for other edge planes of said reservoir description.

* * * * *